US005222907A

United States Patent [19]

Katabuchi et al.

[11] Patent Number: 5,222,907

[45] Date of Patent: Jun. 29, 1993

[54] MULTIPLE-PIN CONNECTOR

[75] Inventors: Kenjiro Katabuchi; Yumiko Suzuki, both of Tokyo, Japan

[73] Assignee: NEC Corporation, Japan

[21] Appl. No.: 926,332

[22] Filed: Aug. 6, 1992

[30] Foreign Application Priority Data

Aug. 13, 1991 [JP] Japan ..... 3-202046

[51] Int. Cl.[5] ..... H01R 13/631

[52] U.S. Cl. ..... 439/377; 439/247; 439/378

[58] Field of Search ..... 439/247, 248, 64, 374, 439/377, 378

[56] References Cited

FOREIGN PATENT DOCUMENTS 0738207 5/1980 U.S.S.R. ..... 439/378

*Primary Examiner*—Eugene F. Desmond

*Attorney, Agent, or Firm*—Ostrolenk, Faber, Gerb & Soffen

[57] ABSTRACT

A plug-in multiple-pin connector has a plug mounted on the backboard of a bookshelf-type unit and a socket mounted on the rear end of a package insertable into the bookshelf-type unit. The plug includes arrays of pins fixed to the bottom of a box-shaped insulative casing and an aligning plate having through holes through which the pins extend. The aligning plate is held in sliding contact with the inner wall surfaces of the plug. The socket has arrays of contact insertion holes defined therein and arrays of socket elements having ends each disposed in the contact insertion holes. When the socket is inserted into the plug, the socket pushes the aligning plate over the pins toward the casing bottom until the aligning plate is held against the casing bottom whereupon engaging prongs on the aligning plate are each forcibly fitted in engaging prongs in the aligning plate. When the socket is pulled out of the plug, the aligning plate is stopped against dislodgement by stoppers of the casing. The pins which are slender and close-spaced are protected against buckling and bending by the aligning plate.

4 Claims, 4 Drawing Sheets

MULTIPLE-PIN CONNECTOR

BACKGROUND OF THE INVENTION

1. Field of the Invention

The present invention relates to a connector for use with communications devices, and more particularly to a plug-in multiple-pin connector for use on the rear end of a package to be inserted into a bookshelf-type unit.

2. Description of the Related Art

Bookshelf-type units have a pair of upper and lower panels with a plurality of upper and lower guide rails mounted on the inner surfaces thereof and a backboard extending between the upper and lower panels. A plug-in multiple-pin connector for use with such a bookshelf-type unit comprises a plug mounted on the backboard and a socket mounted on the rear end of a package supporting an electronic circuit. The package is inserted into the book-shelf-type unit with the upper and lower edges of the package being guided along upper and lower guide rails until the socket is electrically connected to the plug. When a plurality of packages are inserted into the bookshelf-type unit, the packages jointly make up a communications device.

FIGS. 1 and 2 of the accompanying drawings shows one such conventional plug-in multiple-pin connector for use with a bookshelf-type unit.

As shown in FIG. 1, bookshelf-type unit 51 has backboard 52 positioned on the back of the unit and supporting a plurality of plugs 56. Package 53 with an electronic circuit thereon has socket 54 on its rear end. Package 53 is inserted into bookshelf-type unit 51 along selected upper and lower guide rails 55 on upper and lower panels of bookshelf-type unit 51. The distance between the bottoms of the guide grooves in upper and lower guide rails 55 is slightly larger than the vertical dimension of package 53, so that package 53 is slightly loose vertically in guide rails 55 when socket 54 is inserted into plug 56.

As shown in FIG. 2, when socket 54 is fitted into plug 56, socket 54 is guided by beveled edges **56*b* on the open end of box-shaped insulative casing 56*a* of plug 56. Socket 54 has a plurality of contact insertion holes 54*a* each with beveled surfaces 54*b* at their open ends. As socket 54 is inserted into plug 56, pins 56*c* of plug 56 are each guided by beveled surfaces 54*b* and inserted into contact insertion holes 54*a* until pins 56*c* are each electrically connected to socket elements 54*c***.

The conventional plug-in multiple-pin connector suffers from the following two drawbacks:

Recently, there is a demand for more pins per connector and smaller connector sizes to achieve higher packaging density. It is therefore necessary to reduce pin-to-pin spacing and pin diameter. If a package with a plug-in multiple-pin connector designed to meet those requirements is inserted quickly into a bookshelf-type unit, then when the pins strike the beveled surfaces of the contact insertion holes, the pins tend to buckle due to their low mechanical strength, and fail to fit well into the contact insertion holes.

Inasmuch as the pins are slender, they are highly likely to bend under external force, particularly when they are improperly handled while multiple-pin connectors are being fabricated. The small pin-to-pin spacing requires contact insertion holes to have smaller beveled surfaces, making it necessary for the pins to have a minimum degree of bending tolerance. The strict pin tolerance greatly affects both the yield of multiple-pin connectors and the electric connection reliability of the connectors.

SUMMARY OF THE INVENTION

It is an object of the present invention to provide a multiple-pin connector which has pins resistant to buckling or bending.

According to the present invention, there is provided a multiple-pin connector comprising a plug comprising a box-shaped insulative casing having an open side, a bottom surface opposite to the open side, and surrounding walls surrounding the bottom surface, and an array of pins fixedly mounted on the bottom surface of the casing, a socket comprising an insulative housing insertable into the casing through the open side, and an aligning plate movably disposed in the casing and held in sliding contact with the surrounding walls of the casing, the aligning plate having an array of through holes, the pins extending through each of the through holes, the insulative housing and the aligning plate having engaging means for engaging the insulative housing and the aligning plate with each other when the socket is inserted into the plug, the surrounding walls being higher than the pins and having stopper projecting inwardly from distal ends of the surrounding walls at the open side, for preventing the aligning plate from being dislodged from the plug.

The stoppers are disposed in a position in which the pins have tip ends projecting from the aligning plate which is engaged by the stoppers when the socket is removed from the plug.

The distal ends of the surrounding walls have beveled surfaces for guiding the socket when the socket is inserted into the plug.

The multiple-pin connector according to the present invention is designed to reinforce the pins, which are slender, for greater mechanical strength against buckling or bending when they are handled, and also for meeting the requirement for a lower degree of bending tolerance. The aligning plate, which is movably disposed in the casing and held in sliding contact with the surrounding walls of the casing, is positioned in the upper limit position remote from the bottom surface of the casing when the socket is not fitted in the plug. In the upper limit position, the tip ends of the pins slightly project from the aligning plate, and hence the pins are prevented from bending, and also from buckling when they are hit by the socket.

When the socket is inserted into the plug, the aligning plate is pushed by the socket. Continued insertion of the socket into the plug pushes the aligning plate into the plug until the aligning plate reaches the lower limit position against the bottom surface of the casing, whereupon the socket is fully fitted in the plug. To remove the socket from the plug, the socket is pulled out of the plug, and the aligning plate moves with the socket to the upper limit position. When the aligning plate reaches the upper limit position, it abuts the stoppers of the surrounding walls of the casing, and is prevented from being dislodged from the casing. The socket is further pulled out of the plug, disengaging from the aligning plate.

The above and other objects, features and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

FIGS. 3*a* through 3*c* and 4 show a plug-in multiple-pin connector according to the present invention.

Figure 1:
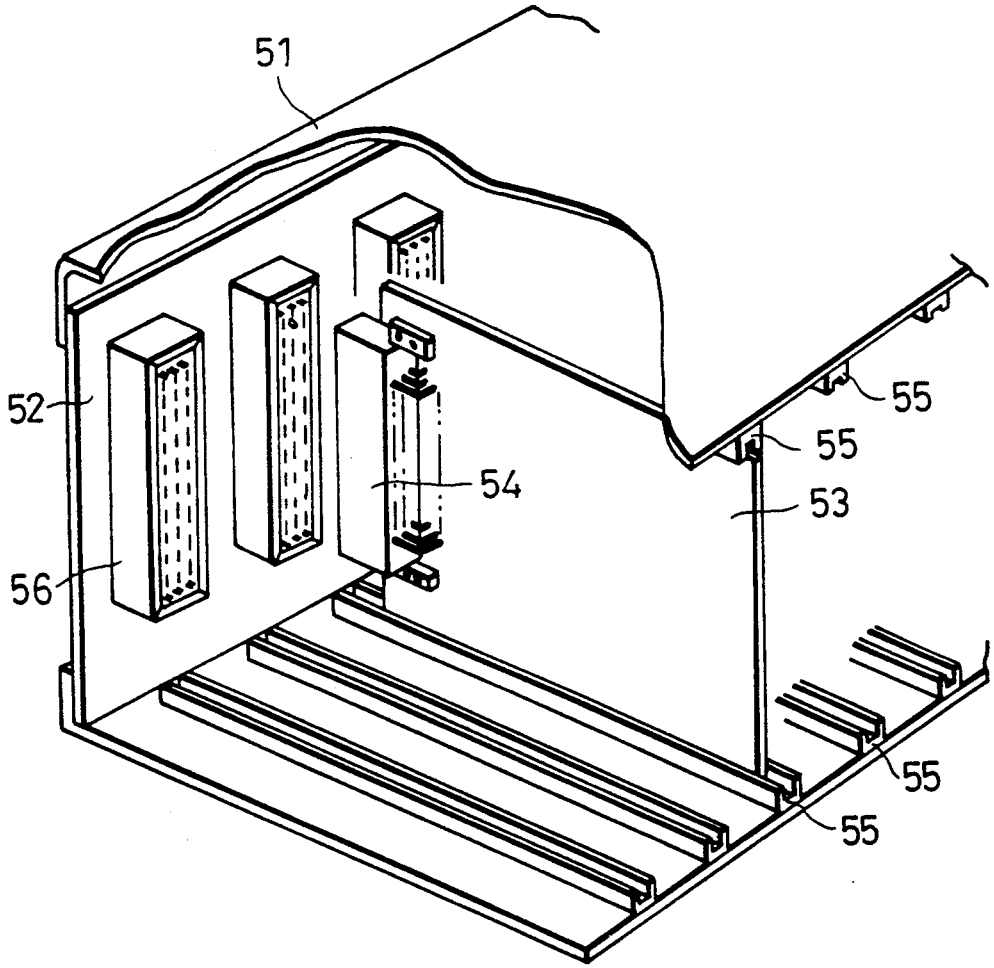
FIG. 1 PRIOR ART
FIG. 1 is a fragmentary perspective view of a bookshelf-type unit and a package with a conventional plug-in multiple-pin connector.
Figure 2:
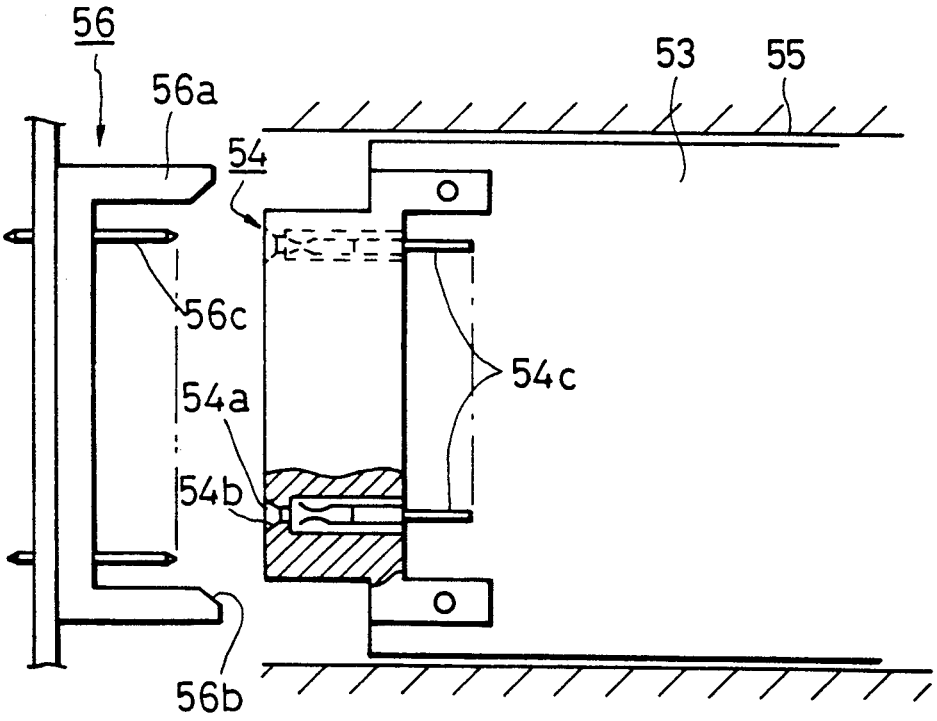
FIG. 2 PRIOR ART
FIG. 2 is an enlarged side elevational view, partly in cross section, of the conventional plug-in multiple-pin connector.

The plug-in multiple-pin connector according to the present invention is useful when employed on the backboard of a bookshelf-type unit and in a package insertable into the bookshelf-type unit, as is the case with the conventional arrangement shown in FIG. 1.

Figure 3A:
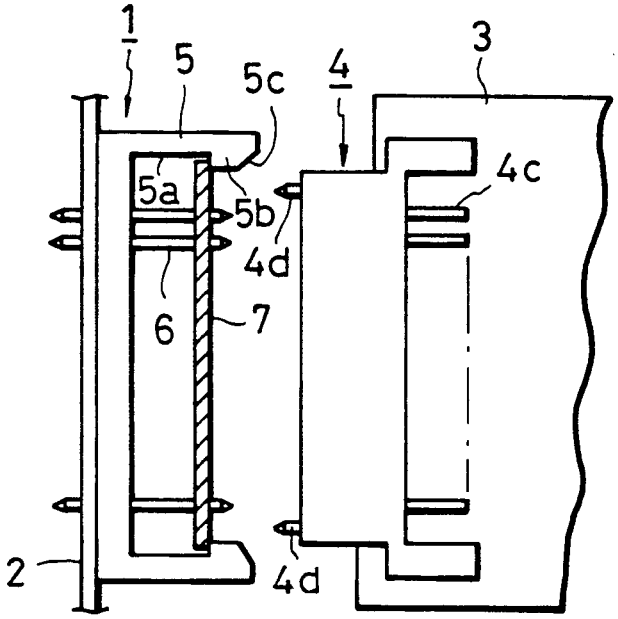
FIGS. 3*a* through 3*c* are enlarged side elevational views, partly in cross section, of a plug-in multiple-pin connector according to the present invention.
Figure 3B:
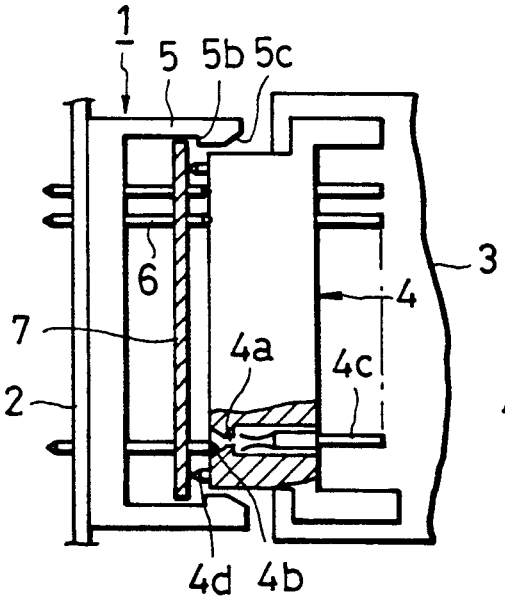
Figure 3C:
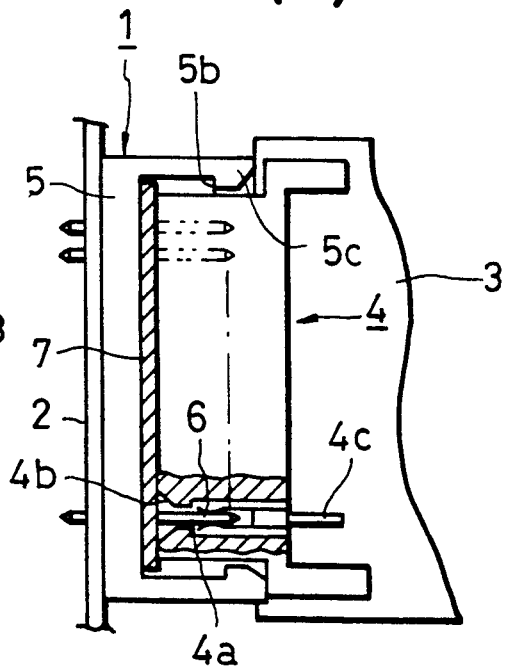

As shown in FIGS. 3*a* through 3*c*, the plug-in multiple-pin connector according to the present invention comprises plug 1 mounted on backboard 2 on the back of a bookshelf-type unit (not shown), and socket 4 on the rear end of package 3. Package 3 can be inserted into the bookshelf-type unit while being guided along guide rails (not shown) on the upper and lower panels of the bookshelf-type unit.

Plug 1 comprises box-shaped insulative casing 5 with one side open opposite to its bottom, a plurality of arrays of pins 6 fixed to the bottom of casing 5, and aligning plate 7 movably disposed in casing 5 and having outer circumferential edges held in sliding contact with inner wall surfaces 5*a* of casing 5.

Casing 5 has surrounding walls higher than pins 6 and having stoppers 5*b* projecting inwardly from the distal ends thereof at the open side of casing 5. Stoppers 5*b* define the upper limit position remote from the bottom surface of casing 5, for limiting sliding movement of aligning plate 7 in casing 5, and serve to prevent aligning plate 7 from being dislodged from casing 5. The distal ends of the surrounding walls of casing 5 have beveled surfaces 5*c* on the inner edges thereof, which serve as guide surfaces for guiding socket 4 when socket 4 is fitted into casing 5.

Aligning plate 7 is of a rectangular shape identical to the bottom surface of casing 5 which is surrounded by the surrounding walls thereof. When aligning plate 7 is placed in casing 5, it is movable in sliding contact with inner wall surfaces 5*a* of casing 5 as described above. Aligning plate 7 has a plurality of arrays of as many through holes 7*a* defined therein as the number of pins 6, through holes 7*a* having cross-sectional dimensions slightly greater than those of pins 6.

Figure 4:
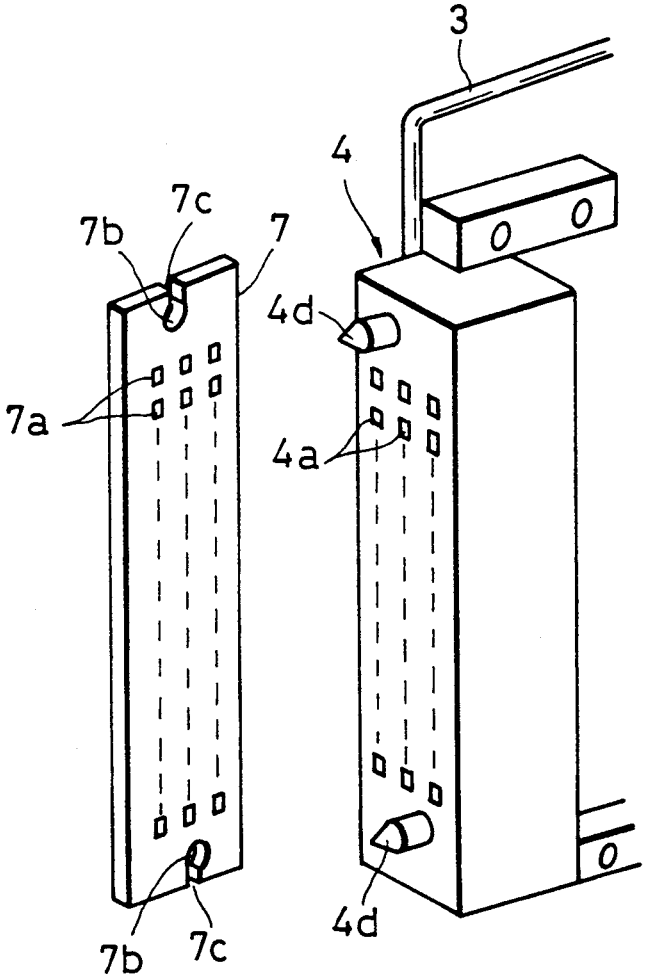
FIG. 4 is an enlarged perspective view of the plug-pin-multiple pin connector according to the present invention.

As shown in FIG. 4, aligning plate 7 has a pair of engaging holes 7*b* defined in each upper and lower end thereof for receiving engaging prongs 4*d* disposed on each upper and lower end of socket 4. Engaging holes 7*b* and engaging prongs 4*d* jointly serve as engaging means. Aligning plate 7 also has a pair of slots 7*c* defined in each end thereof and connected to each engaging holes 7*b*, slots 7*c* being open at the upper and lower end surfaces of aligning plate 7. Engaging holes 7*b* have a diameter substantially equal to or slightly smaller than the diameter of engaging prongs 4*d*. The upper and lower ends of aligning plate 7 where engaging holes 7*b* and slits 7*c* are defined are rendered springy or resilient when slits 7*c* are spread by engaging prongs 4*d* forcibly inserted into each engaging hole 7*b*. When engaging prongs 4*d* are forcibly inserted into respective engaging holes 7*b*, aligning plate 7 and socket 4 are held in interfitting engagement with each other.

As shown in FIGS. 3*a* through 3*c*, socket 4 is in the form of an insulative housing and has a plurality of arrays of socket elements 4*c* having inner ends each disposed in contact insertion holes 4*a* defined in socket 4. When socket 4 is fitted in casing 5, pins 6 are inserted through contact insertion holes 4*a* into each socket element 4*c*, thus achieving electric connection between pins 6 and socket elements 4*c*. As shown in FIG. 3*b*, contact insertion holes 4*a* each have beveled surfaces 4*b* at the outer ends thereof.

Socket 4 is fitted into plug 5 as follows:

When package 3 is inserted into the book-shelf-type unit and before socket 4 reaches plug 5, aligning plate 7 is positioned in the upper limit position in which it is held against stoppers 5*b*, as shown in FIG. 3*a*. At this time, pins 6 have their tip ends projecting slightly from aligning plate 7.

When socket 4 begins to be inserted into plug 1 as shown in FIG. 3*b*, socket 4 is guided by beveled surfaces 5*c*. Therefore, socket 4 can easily be inserted into the open end of casing 5. At this time, aligning plate 7 is pushed by locking prongs 4*d* of socket 4, and pins 6 are guided by beveled surfaces 4*b* and then start fitting into each contact insertion hole 4*a*.

When socket 4 is further inserted into plug 1, as shown in FIG. 3*c*, aligning plate 7 is pushed to the lower limit position against the bottom surface of casing 5, and engaging prongs 4*d* are each forced into engaging holes 7*b* in aligning plate 7. At this time, pins 6 are are each electrically connectd to socket elements 4*c*.

Socket 4 is removed from plug 1 as follows:

When socket 4 is pulled in the direction out of casing 5, aligning plate 7 that is engaged by engaging prongs 4*d* of socket 4 is carried in casing 5 to the upper limit position by socket 4. Upon abutting engagement of aligning plate 7 with stoppers 5*b* of casing 5, aligning plate 7 is stopped against further movement. Continued pulling of socket 4 displaces engaging prongs 4*d* out of engaging holes 7*b*, and socket 4 disengages from aligning plate 7 and returns to the position shown in FIG. 3*a*.

Aligning plate 7 movably disposed in casing 5 is effective to reinforce the mechanical strength of pins 6 which are relatively slender. Therefore, socket 4 can reliably and smoothly be fitted into plug 1 without fail.

Pins 6 are thin and closely spaced because of recent trends toward a large number of pins per connector and high packing density. Nevertheless, the mechanical strength of pins 6 against buckling and bending which would otherwise occur when hit by socket 4 is increased by aligning plate 7 which is held in sliding contact with the inner wall surfaces 5*a* of casing 5. In addition, pins 6 are also protected against bending by aligning plate 7 while the plug-in multiple-pin connector is being manufactured. The degree of bending tolerance for pin 6 may be increased even through the pin-to-pin spacing is small. The plug-in multiple-pin connector can thus be manufactured highly reliably at a high production ratio.

Although a certain preferred embodiment of the present invention has been shown and described in detail, it should be understood that various changes and modifications may be made therein without departing from the scope of the appended claims.

What is claimed is:

1. A multiple-pin connector comprising:

a plug comprising a box-shaped insulative casing having an open side, a bottom opposite to said open side, and surrounding walls surrounding said bottom, and an array of pins fixedly mounted on said bottom of said casing;

a socket comprising an insulative housing insertable into said casing through said open side; and an aligning plate movably disposed in said casing and held in sliding contact with surrounding walls of said casing, said aligning plate having an array of through holes, said pins each extending through said through holes;

said insulative housing and said aligning plate having engaging means for engaging said insulative housing and said aligning plate with each other when said socket is inserted into said plug;

said surrounding walls being higher than said pins and having stoppers projecting inwardly from distal ends of said surrounding walls at said open side, for preventing said aligning plate from being dislodged from said plug.

2. A multiple-pin connector according to claim 1, wherein said stoppers are disposed in a position in which said pins have tip ends projecting from said aligning plate which is engaged by said stoppers when said socket is removed from said plug.

3. A multiple-pin connector according to claim 1, wherein said distal ends of said surrounding walls have beveled surface for guiding said socket when the socket is inserted into said plug.

4. A multiple-pin connector according to claim 2, wherein said distal ends of said surrounding walls have beveled surfaces for guiding said socket when the socket is inserted into said plug.

* * * * *